United States Patent [19]

Pettit et al.

[11] 4,054,960

[45] Oct. 25, 1977

[54] INFLATABLE BODY SUPPORT CUSHION, PARTICULARLY TO SUPPORT A WOMAN DURING PREGNANCY

[76] Inventors: John E. Pettit; Dorothy E. Pettit, both of 18219 46th Place South, Seattle, Wash. 98188

[21] Appl. No.: 699,894

[22] Filed: June 25, 1976

[51] Int. Cl.[2] ..... A61G 07/02

[52] U.S. Cl. ..... 5/357; 5/91; 5/338; 5/349

[58] Field of Search ..... 5/91, 337, 338, 344, 5/352, 357, 365, 349, 350

[56] References Cited

U.S. PATENT DOCUMENTS

| | | | |
|---|---|---|---|
| 1,306,787 | 6/1919 | Stevenson | 5/91 |
| 1,548,728 | 8/1925 | Milam | 5/91 |
| 1,981,666 | 11/1934 | Ridley | 5/91 X |
| 2,465,268 | 3/1949 | Rogers et al. | 5/349 |
| 3,146,469 | 9/1964 | Slade | 5/91 |

FOREIGN PATENT DOCUMENTS

| | | | |
|---|---|---|---|
| 805,685 | 3/1951 | Germany | 5/349 |

*Primary Examiner*—Casmir A. Nunberg
*Attorney, Agent, or Firm*—Roy E. Mattern, Jr.; David H. Deits; Kenneth S. Kessler

[57] ABSTRACT

A continuously and adjustably inflatable cushion supports the entire body length of a prone, face down, expectant mother, and is shaped to accommodate and conform to the enlarged contours of her body during pregnancy and immediately afterward. An essentially circular opening passes completely through the central portion of the supporting cushion, to surround and partially support the enlarged abdomen of the expectant mother. The depth and softness of this opening is varied during progressive stages of pregnancy through a valve mechanism, to add or release air.

When deflated, the cushion is folded into a compact, lightweight configuration for economical packaging and storage. The inflatable cushion has the additional advantages of light weight and portability in either its collapsed or inflated configurations; continuous range of adjustment to accommodate the shape of a human body; and the cushion is preferably constructed from material which is non-flammable, odor free and easily cleaned.

Additional accommodating openings in the cushion structure accommodate the breasts of the mother both during and after childbirth and a breathing opening is provided for the face down, reclining occupant. Internal reinforcing panels and heat seams in the cushion material are utilized to maintain the shape and increase the weight bearing strength of the cushion structure, and to subdivide the cushion into air tight compartments, which can be individually, adjustably inflated. A separable, inflatable plug is provided to fill the central cushion opening, adapting the cushion to use as a conventional air mattress after pregnancy.

1 Claim, 14 Drawing Figures

INFLATABLE BODY SUPPORT CUSHION, PARTICULARLY TO SUPPORT A WOMAN DURING PREGNANCY

BACKGROUND OF THE INVENTION

Modifications have been made to mattresses to adapt to the needs of child bearing women and to provide maximum comfort when she lies in a face down position. However, these mattresses are expensive and too bulky to be easily moved and cannot be taken on trips by the expectant mother. The inflatable body support cushion fills the need for an economic, portable device which can be used alone or with a conventional mattress and may be easily collapsed to a very light weight and compact configuration which will fit in the purse of an expactant mother. For example, the inventions of Mr. Milan, described in U.S. Pat. No. 1,548,728 and Mr. Skinner, U.S. Pat. No. 3,378,862 are both full sized mattresses which are bulky, difficult to clean, and flammable. Although Mr. Skinner's invention comforms somewhat to body contours by means of a stretchable support panel, it lacks the range and sensitivity of adjustment available in the present invention, by varying the inflation of a cushion which substantially surrounds and supports the expectant mother's abdomen.

The invention of Mr. Talley, described in U.S. Pat. No. 3,118,152, is an abdomen accommodating pad which while more portable than a full mattress, still is much more bulky and lacks the adjustability of an inflatable device. Also, Mr. Talley's mattress pad does not support the full length of the reclining body, thus requiring the use of additional support.

The present invention provides a great improvement over the prior art in that it greatly increases portability, economy and adjustability and is safer for use because it is non-flammable and sanitary.

SUMMARY OF THE INVENTION

An inflatable, body supporting cushion is designed to comfortably support an expectant mother who may prefer to sleep on her stomach to avoid lower back discomfort which is sometimes experienced if she sleeps on her back. This inflatable cushion may be used alone or on top of a conventional mattress and provides adjustable, continuous conformability to body contours in various progressive stages of pregnancy. The cushion is easily deflated by hand to form a very light weight, compact unit which may be carried in the expectant mother's purse. Also, the collapsed cushion is efficiently stored or transported.

An essentially circular cavity is formed by an opening which passes through both the upper and lower horizontal surfaces of the cushion, to accommodate and partially support the enlarged abdomen of the expectant mother as she lies in a prone position. The rounded edge between the upper, weight bearing surface of the inflatable cushion and the opening or cavity forms a shoulder to comfortably support the expanded abdomen during pregnancy. The softness and depth of the cavity or opening is continuously adjustable as air is added to or released from the inflatable cushion, by a valve or other inflating and sealing means.

The inflatable, body supporting cushion is preferably made from plastic and is thus non-flammable and sanitary and easily cleaned. Even when fully inflated, the cushion is a light weight, unitary structure which is easy to handle and adjust. The inflatable cushion is economical to manufacture by utilizing conventional fabrication means in the production of inflatable goods and when deflated is foldable for efficient and compact packaging or storage.

In one embodiment, the body support cushion is formed with rib-like seams running lengthwise along the cushion horizontal surfaces, parallel to the supported body. Internal panels are connected between said ribs on the respective upper and lower cushion surfaces, dividing the cushion into tubular sub-compartments and serving to increase the strength of the cushion and maintain its shape when weighted. An essentially circular opening passes through the center of the cushion and is shaped to conform to a woman's expanded abdomen during pregnancy. An inflatable plug is provided to fill the opening, thereby allowing the cushion to be used as a conventional air mattress. The head end of the cushion is notched, to form an opening through both the upper and lower surfaces of the cushion to permit airflow around the face of the downward facing occupant.

In a seccond embodiment, the cushion is divided into three separately inflatable sections by two heat seams running perpendicular to the length of the supported occupant. The abdomen accommodating opening is formed in the center section and may be adjusted independently of the two end sections, permitting greater conformability and adjustment during progressive stages of pregnancy. As in the first embodiment, a breathing opening and plug for the center cavity are provided.

The heat seam between the center section and the upper body supporting section may be widened and positioned to form a concavity with the additional advantage of providing an accommodating space for the enlarged breasts of a mother who may be nursing an infant after childbirth.

DESCRIPTION OF THE DRAWINGS

In FIG. 2 the separated plug is shown and in FIG. 3, it fills the central cushion opening. FIG. 4 depicts the expectant mother's expanded abdomen being supported by the rounded shoulder of the cushion opening.

In FIG. 6 the face down occupant is shown, utilizing the breathing passage.

FIG. 8 is a perspective view of the body supporting cushion, showing the separated plug for the abdomen accommodating opening.

FIGS. 9, 10 and 11 are cross sectional views taken along a vertical plane cutting across the center of the cushion. In FIG. 9 the plug is separated and in FIG. 10 it fills the central abdomen accommodating opening. In FIG. 11, the expectant mother's abdomen is supported by the shoulder of the cushion opening.

FIGS. 12 and 13 are taken along a cross sectional vertical plane, intersecting the head supporting end of the cushion. In FIG. 12 the breathing opening is shown and in FIG. 13 the face down reclining occupant is utilizing the breathing passage.

FIG. 14 is a cross sectional view taken along a vertical plane running lengthwise through the center of the body supporting cushion, showing the central, abdomen accommodating opening, the breathing opening, internal strengthening panels and an extended heat seam to provide an opening for the breasts of a mother, both during and after pregnancy.

DESCRIPTION OF THE PREFERRED EMBODIMENTS

Figure 1:
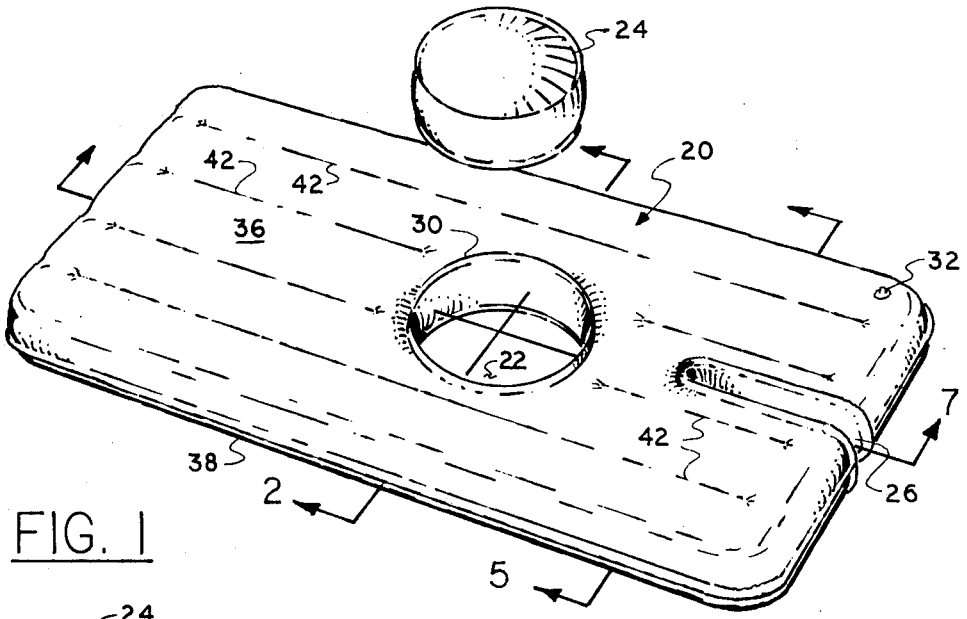
FIG. 1 illustrates a perspective view of one embodiment of the inflatable, body supporting cushion, having a centrally located abdomen accommodating opening with a separable, inflatable plug.
Figure 2:
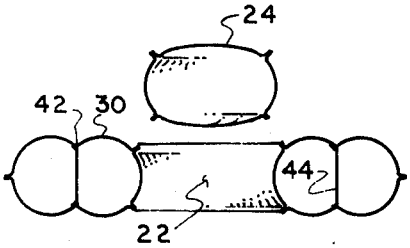
FIGS. 2, 3 and 4 are cross sectional views, all taken along a vertical plane running cross ways through the center of the cushion.
Figure 5:
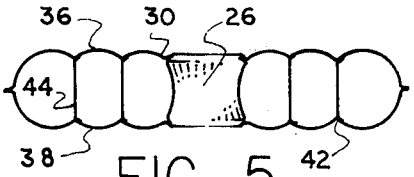
FIGS. 5 and 6 are cross sectional views of the cushion taken along a vertical plane through the head supporting end of the cushion, showing a breathing opening for the face down, reclining occupant.
Figure 3:
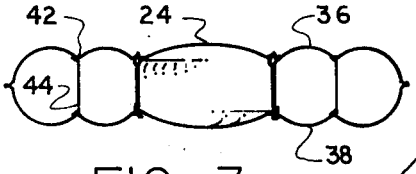

One possible embodiment of the body supporting cushion 20 is illustrated in FIGS. 1 through 7. FIG. 1 depicts, in a perspective view, an inflated body cushion 20, with a centrally located opening 22 to accommodate the abdomen 28 of an expectant mother. An inflatable plug 24, to fill the opening when the cushion 20 is used other than during pregnancy is shown removed. In FIG. 3, the inflatable plug 24 is illustrated, in place in the cushion opening 22. An additional opening 26 to permit breathing air flow for the face down, reclining occupant is provided at one end of the cushion 20.

Figure 6:
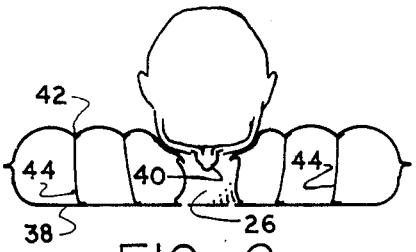
Figure 4:
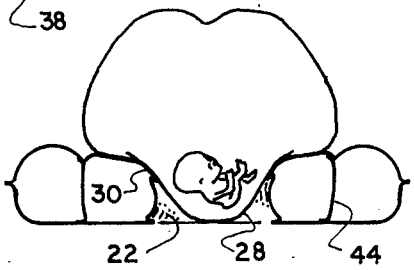
Figure 7:
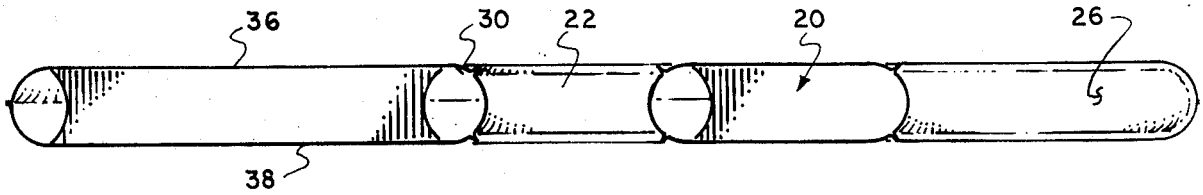
FIG. 7 is a cross sectional view taken along a vertical plane running lengthwise through the center of the body supporting cushion, showing the central, abdomen accommodating opening, the breathing opening, and an internal strengthening panel.
Figure 8:
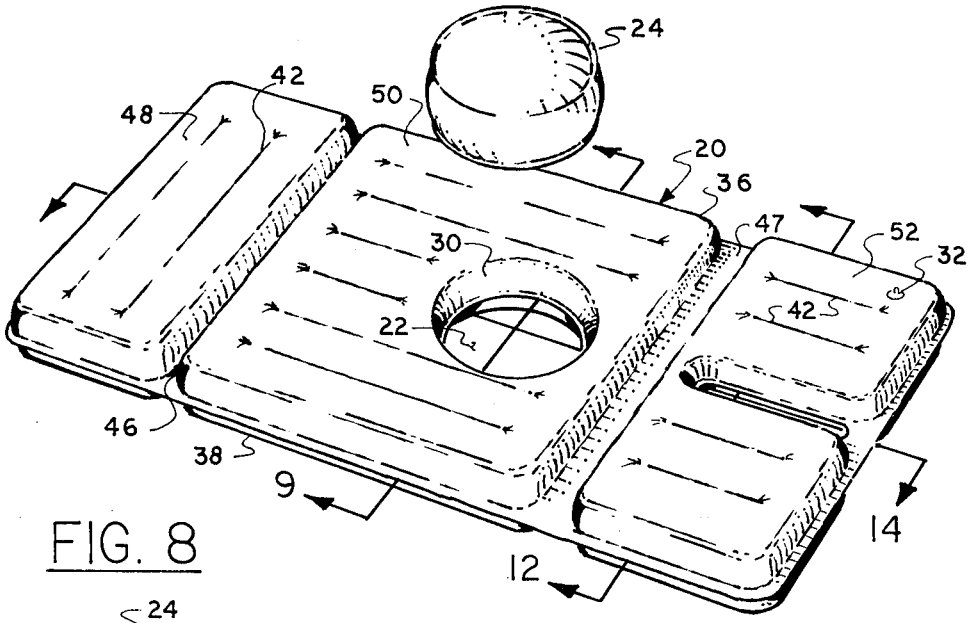
FIGS. 8 through 14 illustrate an additional embodiment of the body supporting cushion, having independently inflatable compartments, separated by heat seams.
Figure 9:
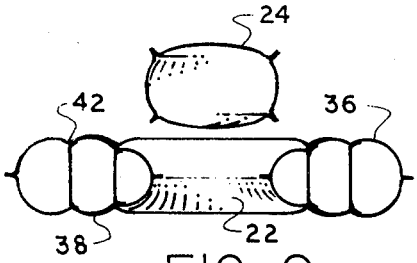
Figure 12:
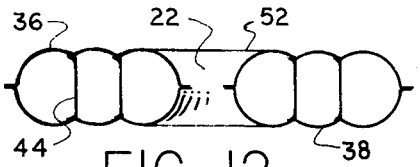
Figure 10:
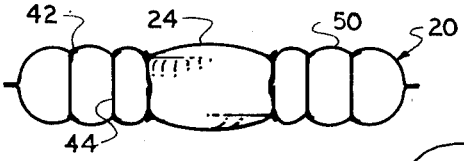
Figure 13:
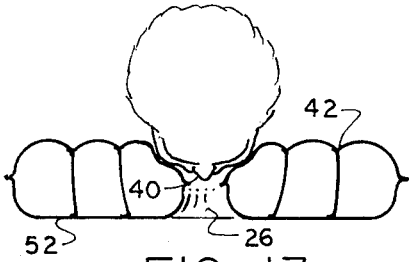
Figure 11:
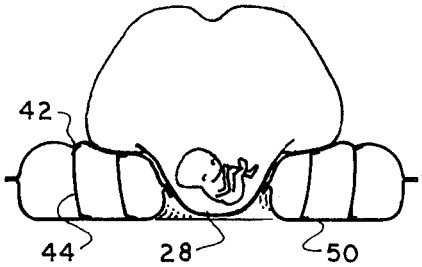

The body supporting cushion 20 supports the full length of an expectant mother who prefers to sleep in a face downward position, and is shaped to conform to the contours of her body. FIG. 4 illustrates, in a cross sectional view, the mother's extended abdomen 28, accommodated and supported by the rounded shoulder 30 of the central cushion opening 22. During progressive stages of pregnancy, the air pressure in the cushion may be adjusted by operation of a conventional valve mechanism 32, to vary the depth and cushioning effect of the supporting shoulder 30 to most comfortably support the reclining occupant. To enable the occupant to lie in close contact with the cushion 20, an opening 26 is provided through both the upper 36 and lower 38 cushion surfaces, which allows breathing air to circulate around the face 40 of the prone occupant as shown in FIG. 6.

The cushion 20 is strengthened and its shape maintained when weighted by the use of pleats or ribs 42 formed in the surface of the cushion material and by internal panels 44 which are positioned in an essentially vertical plane, spanning and connecting pleats or ribs 42 in the respective upper 36 and lower 38 cushion surfaces.

A second possible embodiment of the body supporting cushion 20 is illustrated in FIGS. 8 through 11. This embodiment utilizes heat seams 46 and 47 to join and seal the respective upper 36 and lower 38 surfaces of the cushion 20 to thereby form independently inflatable sub-compartments 48, 50 and 52. The central sub-compartment 50, for example, may be independently adjusted to soften or stiffen support of the expectant mother's abdomen, while other body supporting sub-compartments 48 and 52 are not effected.

Figure 14:
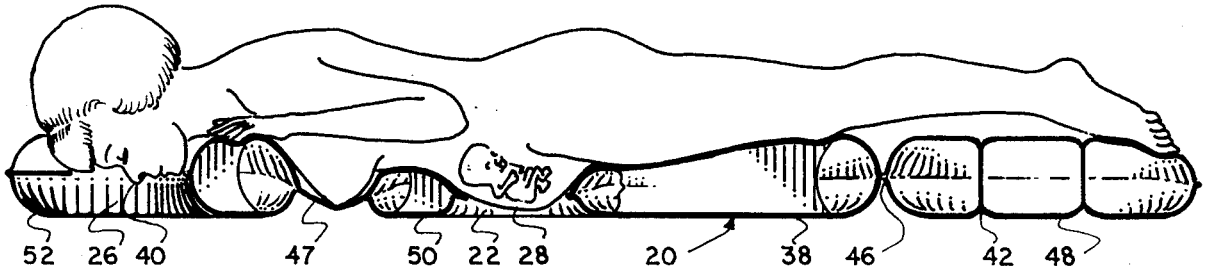

An extended heat seam 47, between the central sub-compartment 50 and the head supporting compartment 52 is widened to provide a space in the cushion 20 to accommodate the breasts of the mother, both during and immediately after pregnancy. In FIG. 14, these features are illustrated in profile by a lengthwise, sectional view of the accommodation of the cushion 20 to body contours.

SUMMARY OF ADVANTAGES

Some of the advantages of using this inflatable cushion to comfortably support a child bearing woman in a face down position are:

1. By varying the amount of inflation, this inflatable body support cushion is infinitely adjustable to the physical shape of a human body.
2. This inflatable body support cushion is easily deflated for storage or shipment, and is totally portable when collapsed to its light weight, non-bulky configuration.
3. This inflatable body support cushion is non-flammable and odor free and easily cleaned.
4. The inflatable body support cushion is economical to manufacture, package and display.

We claim:

1. A resting support cushion for a pregnant woman, being fully collapsible, which is selectively inflated to degrees of firmness to directly support her throughout her body, except for the indirect support of her expanded abdomen, her enlarged breasts, and her central face, comprising:

a. a continuous surrounding central web portion positioning three otherwise separated inflatable portions of this resting support of full body length;

b. a head supporting inflatable portion at the commencement of the continuous surrounding central web portion having two interconnected inflatable portions spaced apart along a portion of the center line of this resting support, thereby creating a breathing space for a pregnant woman resting in a face down position;

c. a central body supporting inflatable portion positioned by the continuous surrounding cental web at a reasonably wide transverse spacing from the head supporting inflatable portion, thereby creating a space between them to accommodate the enlarged breasts of a pregnant woman resting in a face down position, and this central body supporting inflatable portion having a circular opening therethrough, thereby creating a space to accommodate the expanded abdomen of a pregnant woman; and d. a feet and legs supporting inflatable portion positioned by the continuous surrounding central web at a narrow transverse spacing from the central body supporting inflatable portion, thereby completing the overall comfortable resting support of a pregnant woman.

* * * * *